US010227816B2

(12) United States Patent
Kim

(10) Patent No.: US 10,227,816 B2
(45) Date of Patent: Mar. 12, 2019

(54) STRUCTURE OF NON-INTERFERENCE FRONT-SURFACE OPENING/CLOSING-TYPE FRAME

(71) Applicants: HUDECO CO., LTD., Jeonju-si, Jeollabuk-do (KR); Gang Seop Kim, Jeonju-si, Jeollabuk-do (KR)

(72) Inventor: Gang Seop Kim, Jeonju-si (KR)

(73) Assignees: HUDECO CO., LTD., Jeonju-si, Jeollabuk-do (KR); Gang Seop Kim, Jeonju-si, Jeollabuk-do (KR)

( * ) Notice: Subject to any disclaimer, the term of this patent is extended or adjusted under 35 U.S.C. 154(b) by 0 days.

(21) Appl. No.: 15/570,563

(22) PCT Filed: May 4, 2016

(86) PCT No.: PCT/KR2016/004748
§ 371 (c)(1),
(2) Date: Oct. 30, 2017

(87) PCT Pub. No.: WO2016/178530
PCT Pub. Date: Nov. 10, 2016

(65) Prior Publication Data

US 2018/0128035 A1 May 10, 2018

(30) Foreign Application Priority Data

May 4, 2015 (KR) ..... 10-2015-0062635

(51) Int. Cl.
*E06B 3/30* (2006.01)
*A47G 1/06* (2006.01)
(Continued)

(52) U.S. Cl.
CPC ..... *E06B 3/30* (2013.01); *A47B 96/00* (2013.01); *A47B 96/20* (2013.01); *A47G 1/06* (2013.01); *E06B 3/00* (2013.01); *E06B 3/12* (2013.01)

(58) Field of Classification Search
CPC .... E06B 3/30; E06B 3/12; A47G 1/06; A47B 96/20
(Continued)

(56) References Cited

U.S. PATENT DOCUMENTS 4,483,100 A * 11/1984 Blankenburg ..... E05F 11/426 49/352
4,512,094 A * 4/1985 Seely ..... G09F 15/0018 40/647
(Continued)

FOREIGN PATENT DOCUMENTS

KR 20-0263945 Y1 2/2002
KR 2005-0117623 A 12/2005
(Continued)

*Primary Examiner* — Joshua K Ihezie
(74) *Attorney, Agent, or Firm* — Novick, Kim & Lee, PLLC; Jae Youn Kim

(57) ABSTRACT

Provided is a structure of a non-interference front-surface opening and closing-type frame, which is advantageous in that, since a cover frame can be conveniently coupled right beneath a fixing frame, assembly of the cover frame and the fixing frame is substantially facilitated, it becomes easier to prevent the cover frame from being separated from the fixing frame by an external impact, and the vertical width between the lower portion of a rotating shaft of the cover frame and the lower portion of a compression piece is substantially reduced, thereby realizing slimness.

13 Claims, 12 Drawing Sheets

(51) Int. Cl.

| | |
|---|---|
| ***A47B 96/00*** | (2006.01) |
| ***E06B 3/00*** | (2006.01) |
| ***A47B 96/20*** | (2006.01) |
| ***E06B 3/12*** | (2006.01) |

(58) Field of Classification Search
USPC ..... 40/790, 791, 792, 793, 794
See application file for complete search history.

(56) References Cited

U.S. PATENT DOCUMENTS 4,702,025 A * 10/1987 Mace ..... A47G 1/0611 40/647
4,958,458 A * 9/1990 Hillstrom ..... A47G 1/0611 40/647
5,735,069 A * 4/1998 Gearing ..... G09F 15/0018 40/606.18
6,088,942 A * 7/2000 Brooks ..... G09F 15/0025 160/328
6,233,859 B1 * 5/2001 Kilpatrick ..... A47G 1/0611 24/67.3
8,196,325 B2 * 6/2012 Pitcher ..... G09F 3/20 248/229.1
8,578,641 B2 * 11/2013 Suciu ..... G09F 3/20 248/229.1
8,808,006 B2 * 8/2014 Ureles ..... B43K 23/002 434/415
8,826,572 B2 * 9/2014 Kaoh ..... G09F 27/005 40/544
9,038,301 B2 * 5/2015 Zelbacher ..... A47G 1/0622 40/790
9,873,286 B1 * 1/2018 McAtee ..... B43L 1/00

FOREIGN PATENT DOCUMENTS

KR 10-2006-0003245 A 1/2006
KR 20-0434004 Y1 12/2006
KR 10-0733325 B1 6/2007
KR 2007-0098114 A 10/2007
KR 20-0471250 Y1 2/2014
KR 10-1384436 B1 4/2014
KR 20-0474573 Y1 9/2014
KR 20-0475897 Y1 1/2015

* cited by examiner

STRUCTURE OF NON-INTERFERENCE FRONT-SURFACE OPENING/CLOSING-TYPE FRAME

TECHNICAL FIELD

The present invention relates to a structure of a non-interference front-surface opening/closing-type frame, wherein, since a cover frame can be conveniently coupled right beneath a fixing frame, assembly of the cover frame and the fixing frame is substantially facilitated, it becomes easier to prevent the cover frame from being separated from the fixing frame by an external impact, and the vertical width between the lower portion of a rotating shaft of the cover frame and the lower portion of a compression piece is substantially reduced, thereby realizing slimness.

Also, the present invention relates to the structure of a non-interference front-surface opening/closing-type frame, wherein: the cover frame can efficiently open/close the fixing frame without interference of the fixing frame; escapement of the rotating shaft from the shaft groove can be prevented while the cover frame opens/closes the fixing frame; there is no concern that an elastic member may act as an interfering element during assembly of the fixing frame and the cover frame; and it becomes easier to maintain the state in which the cover frame closes the fixing frame.

Also, the present invention relates to the structure of a non-interference front-surface opening/closing-type frame, wherein, when the cover frame opens the fixing frame, the cover frame can open the fixing frame more easily with no concern that the cover frame may contact a structure, such as a building wall body, and be interfered with, thereby substantially facilitating extended application to metal furniture of industrial materials, such as picture frames and door frames, or construction window/door frames.

BACKGROUND ART

Generally, frames for pictures widely used include: a picture frame having a stepped portion formed on a bottom surface thereof; and a rear plate that is seated on the stepped portion of the picture frame and fixed to the picture frame by a fixing member separately provided. The prior art documents relating to the picture frame constructing the frames for pictures were suggested with Korean Patent Publication No. 2007-0098114 (Hereinafter, referred to as 'Prior Art Document 1'), Korean Patent Publication No. 2005-0117623 (Hereinafter, referred to as 'Prior Art Document 2'), Korean Patent No. 1384436 (Hereinafter, referred to as 'Prior Art Document 3'), Korean patent No. 0733325 (Hereinafter, 'Prior Art Document 4'), Korean patent No. 0475897 (Hereinafter 'Prior Art Document 5'), Korean Utility Model Registration No. 0474573 (Hereinafter, 'Prior Art Document 6'), Korean Utility Model Registration No. 0434004 (Hereinafter, referred to as 'Prior Art Document 7'), Korean Patent Publication No. 2006-0003245 (Hereinafter, referred to as 'Prior Art Document 8'), and Korean Utility Model Registration No. 0263945 (Hereinafter, referred to as 'Prior Art Document 9').

However, in the case of Prior Art Document 1, since a rib of a base frame inserted into a recess of a cover frame is formed on one side or a lateral of an lower portion of the base frame, the cover frame passes over and opens the base frame while being deviated in an outward direction of a lower side of the base frame when the cover frame opens the base frame. Therefore, when the base frame is fixed to a structure such as a building wall body located in a bottom surface of the base frame, the cover frame contacts the structure and is interfered by the structure while opening the base frame, thereby making the opening of the base frame difficult.

Also, in the case of Prior Art Document 2, since a rotating projection of a fixing frame inserted into a curved portion of a front surface frame is formed in an upper portion of one side of the fixing frame, the front surface frame passes over and opens the fixing frame while being deviated in an outward direction of the one side of the fixing frame when the front surface frame opens the fixing frame. Therefore, when the fixing frame is fixed to a structure such as a building wall body located in the one side of the fixing frame, the front surface frame contacts the structure and is interfered by the structure while opening the fixing frame, thereby making the opening of the fixing frame difficult.

Also, in the case of Prior Art Document 3, since a hinge portion of a base frame inserted into a shaft groove of a cover frame is formed in an upper portion of one end of the base frame, the cover frame passes over and opens the base frame while being deviated in an outward direction of one side of the base frame when the cover frame opens the base frame. Therefore, when the base frame is fixed to a structure such as a building wall body located in the one side of the base frame, the cover frame contacts the structure and is interfered by the structure while opening the base frame, thereby making the opening of the base frame difficult.

In addition, in the case of Prior Art Document 3, there is a concern that the hinge portion of the base frame is likely to escape from the shaft groove of the cover frame due to an external force applied to the cover frame, and thus the cover frame may be easily separated from the base frame.

Also, in the case of Prior Art Document 4, since a shaft groove into which a rotating shaft of a front surface frame is inserted is formed in an upper portion of one end of a fixing frame, the front surface frame passes over and opens the fixing frame while being deviated in an outward direction of one side of the fixing frame when the front surface frame opens the fixing frame. Therefore, when the fixing frame is fixed to a structure such as a building wall body located in the one side of the fixing frame, the front surface frame contacts the structure and is interfered by the structure while opening the fixing frame, thereby making the opening of the fixing frame difficult.

In addition, in the case of Prior Art Document 4, there is a concern that, because the shaft groove is opened inward and upward, the rotating shaft easily escapes from the shaft groove due to an external force applied to the front surface frame, and thus the front surface frame may be separated from the fixing frame.

Also, in the case of Prior Art Document 5, since a shaft groove into which a shaft-bundle of a main body is inserted is formed on one side of a lower portion of a cover, the cover passes over and opens the main body while being deviated in an outward direction of one side of the main body when the cover opens the main body. Therefore, when the main body is fixed to a structure such as a building wall body located in the one side of the main body, the cover contacts the structure and is interfered by the structure while opening the main body, thereby making the opening of the main body difficult.

Also, in the case of Prior Art Document 6, since a hinge groove into which a cover hook projection of a cover frame is inserted is formed in an upper portion of one side of a base frame, the cover frame passes over and opens the base frame while being deviated in an outward direction of the one side of the base frame when the cover frame opens the base frame. Therefore, when the base frame is fixed to a structure such as a building wall body located in the one side of the base frame, the cover frame contacts the structure and is interfered by the structure while opening the base frame, thereby making the opening of the base frame difficult.

Also, in the case of Prior Art Document 7, since a supporting piece of a fixing frame into which a hinge portion of a front surface frame is formed on one side of an lower portion of the fixing frame, the front surface frame passes over and opens the fixing frame while being deviated in an outward direction of a bottom side of the fixing frame when the front surface frame opens the fixing frame. Therefore, when the fixing frame is fixed to a structure such as a building wall body located in the bottom surface of the fixing frame, the front surface frame contacts the structure and is interfered by the structure while opening the fixing frame, thereby making the opening of the fixing frame difficult.

Also, in the case of Prior Art Document 8, an opening angle of a coupling groove of a front surface frame is as small as 180° or less, so it is not easy to couple a coupling projection of a fixing frame to the coupling groove of the front surface frame, thereby deteriorating assemblability of the front surface frame and the fixing frame.

Also, in the case of Prior Art Document 9, it is practically difficult to couple a rotating part of a folding-type front surface frame to a rotating part-coupling groove of a fixing frame due to characteristics of an extruded frame, so they should be forcibly coupled, thereby deteriorating assemblability of the folding-type front surface frame and the fixing frame.

DISCLOSURE OF THE INVENTION

Technical Problem

The present invention has been made to solve the above-described problems, and an object of the present invention is to provide a structure of a non-interference front-surface opening/closing-type frame, wherein, since a cover frame can be conveniently coupled right beneath a fixing frame, assembly of the cover frame and the fixing frame is substantially facilitated, it becomes easier to prevent the cover frame from being separated from the fixing frame by an external impact, and the vertical width between the lower portion of a rotating shaft of the cover frame and the lower portion of a compression piece is substantially reduced, thereby realizing slimness.

Also, an object of the present invention is to provide a structure of a non-interference front-surface opening/closing-type frame, wherein: the cover frame can efficiently open/close the fixing frame without interference of the fixing frame; escapement of the rotating shaft from the shaft groove can be prevented while the cover frame opens/closes the fixing frame; there is no concern that an elastic member may act as an interfering element during assembly of the fixing frame and the cover frame; and it becomes easier to maintain the state in which the cover frame closes the fixing frame.

Also, an object of the present invention is to provide a structure of a non-interference front-surface opening/closing-type frame, wherein, when the cover frame opens the fixing frame, the cover frame can open the fixing frame more easily with no concern that the cover frame may contact a structure, such as a building wall body, and be interfered with, thereby substantially facilitating extended application to metal furniture of industrial materials, such as picture frames and door frames, or construction window/door frames.

Technical Solution

In order to achieve the above-identified objects, the present invention provides a structure of a non-interference front-surface opening/closing-type frame, the structure including: a fixing frame; a cover frame rotatably coupled to the fixing frame; and an elastic member interposed between the fixing frame and the cover frame, wherein the fixing frame includes: a protrusion protruding downward from one end of the fixing frame in a lateral direction; and a shaft groove opened inward and downward inside the protrusion, and the cover frame includes: a rotating shaft inserted into the shaft groove; a compression piece formed sharply inward and downward from the rotating shaft and elastically supported by the elastic member; and a connection piece connecting the other end of the cover frame and the compression piece.

In this case, it is preferable that the protrusion and the shaft groove of the fixing frame are formed in a circular arc shape having the same center.

Also, it is preferable that the connection piece of the cover frame and the shaft groove of the fixing frame are formed in a circular arc shape having the same center.

In addition, it is preferable that an opening angle of the shaft groove of the fixing frame ranges from 180° to 270°.

Also, it is preferable that the compression piece is formed sharply inward and downward from the rotating shaft in a state in which upper and lower portions of the compression piece of the cover frame have an acute angle therebetween.

Furthermore, it is preferable that a connection part connecting the rotating shaft and the compression piece is formed between the rotating shaft and the compression piece of the cover frame while being inclined inward and downward from the rotating shaft.

Moreover, it is preferable that a pressing piece, which protrudes in a downward direction of the fixing frame to press the elastic member, is formed in an inner upper portion of the fixing frame.

Additionally, it is preferable that an insertion projection is formed in a lower portion of the pressing piece, and an inserting groove, into which the insertion projection is inserted, is formed in the upper portion of the compression piece.

In addition, it is preferable that a supporting piece, which is seated on the fixing frame to support the cover frame, is formed on a central lower portion of the cover frame.

Also, it is preferable that an upper plate part, which horizontally extends by a predetermined length in one side or a lateral direction of the fixing frame, is formed on an upper end of a vertical plate part formed on the other side of the fixing frame, and the protrusion is formed on the bottom surface of one end of the upper plate part.

Advantageous Effects

According to the present invention, since a rotating shaft of a cover frame can be conveniently coupled right beneath a shaft groove of a fixing frame, the cover frame may be so easily assembled with the fixing frame. Also, a protrusion, in which the shaft groove is defined, protrudes downward from one end of the fixing frame in one side (a lateral) direction, and a compression piece included in the cover frame and elastically supported by an elastic member is formed to be sharp inward and downward from the rotating shaft, thereby easily preventing the cover frame from being separated from the fixing frame due to an external impact such as a pushing force applied to the cover frame, and substantially reducing the vertical width between the lower portion of the rotating shaft of the cover frame and the lower portion of the compression piece to realize slimness.

In addition, since the protrusion of the fixing frame, a connection piece of the cover frame, and the shaft groove of the fixing frame are formed in a circular arc shape having the same center, the cover frame can smoothly open/close the fixing frame without interference of the fixing frame.

Also, since an opening angle of the shaft groove of the fixing frame ranges from 180° to 270°, the rotating shaft of the cover frame can be conveniently coupled right beneath the shaft groove of the fixing frame, and escapement of the rotating shaft coupled right beneath the inside of the shaft groove can be prevented while the cover frame opens/closes the fixing frame.

In addition, by means of a pressing piece formed in the inner upper portion of the fixing frame to press the elastic member, the compression piece of the cover frame is allowed to pass through the gap between the protrusion of the fixing frame and the elastic member in order to assemble the fixing frame and the cover frame, with no concern that the elastic member may act as an interfering element.

Also, by means of an insertion projection that is formed in the lower portion of the pressing piece of the fixing frame and inserted into an inserting groove formed in the upper portion of the compression piece of the cover frame, it may become easier to maintain the state in which the cover frame closes the fixing frame.

In addition, a supporting piece formed on the central lower portion of the cover frame is seated on the fixing frame to support the cover frame, and thus can easily prevent the cover frame from being pushed and pressed due to an external impact such as a pushing force, thereby easily preventing the cover frame from being separated from the fixing frame due to the external impact such as the pushing force.

Also, the rotating shaft of the cover frame is inserted into the shaft groove of the protrusion formed on the bottom surface of one end of an upper plate part, wherein the upper plate part extends, from the upper end of a vertical plate part formed on the other side of the fixing frame, horizontally by a predetermined length in one side (a lateral) direction of the fixing frame. Thus, when the cover frame opens the fixing frame in such a manner in which one side of the cover frame is rotated in an upward direction of the fixing frame, the cover frame passes over in an outward direction of the other side of the fixing frame while not being deviated. Therefore, when the fixing frame is fixed to an inner groove of a structure such as a building wall body, there is no concern that the cover frame may be contacted to and interfered with the structure. As a result, the cover frame can more simply open the fixing frame, to thereby more easily and widely apply the structure of the non-interference front-surface opening/closing-type frame of the present invention to metal furniture of industrial materials, such as picture frames and door frames, or construction window/door frames.

MODE FOR CARRYING OUT THE INVENTION

Hereinafter, preferable embodiments of the present invention will be described below in more detail with reference to the accompanying drawings. However, the scope of right of the present invention is not limited to the following embodiments, and may be variously modified by those with ordinary skill in the technical field without departing from the technical subject matter of the present invention.

Figure 1:
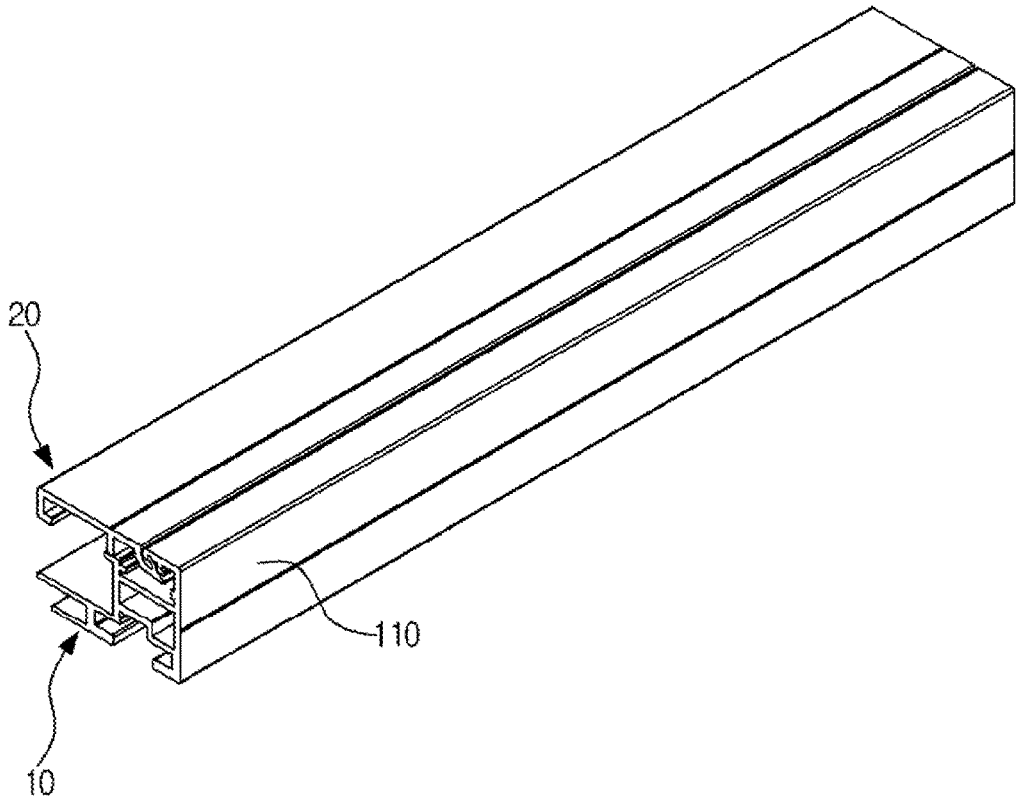
FIG. 1 is a perspective view schematically illustrating a structure of a non-interference front-surface opening/closing-type frame according to one embodiment of the present invention.
Figure 2:
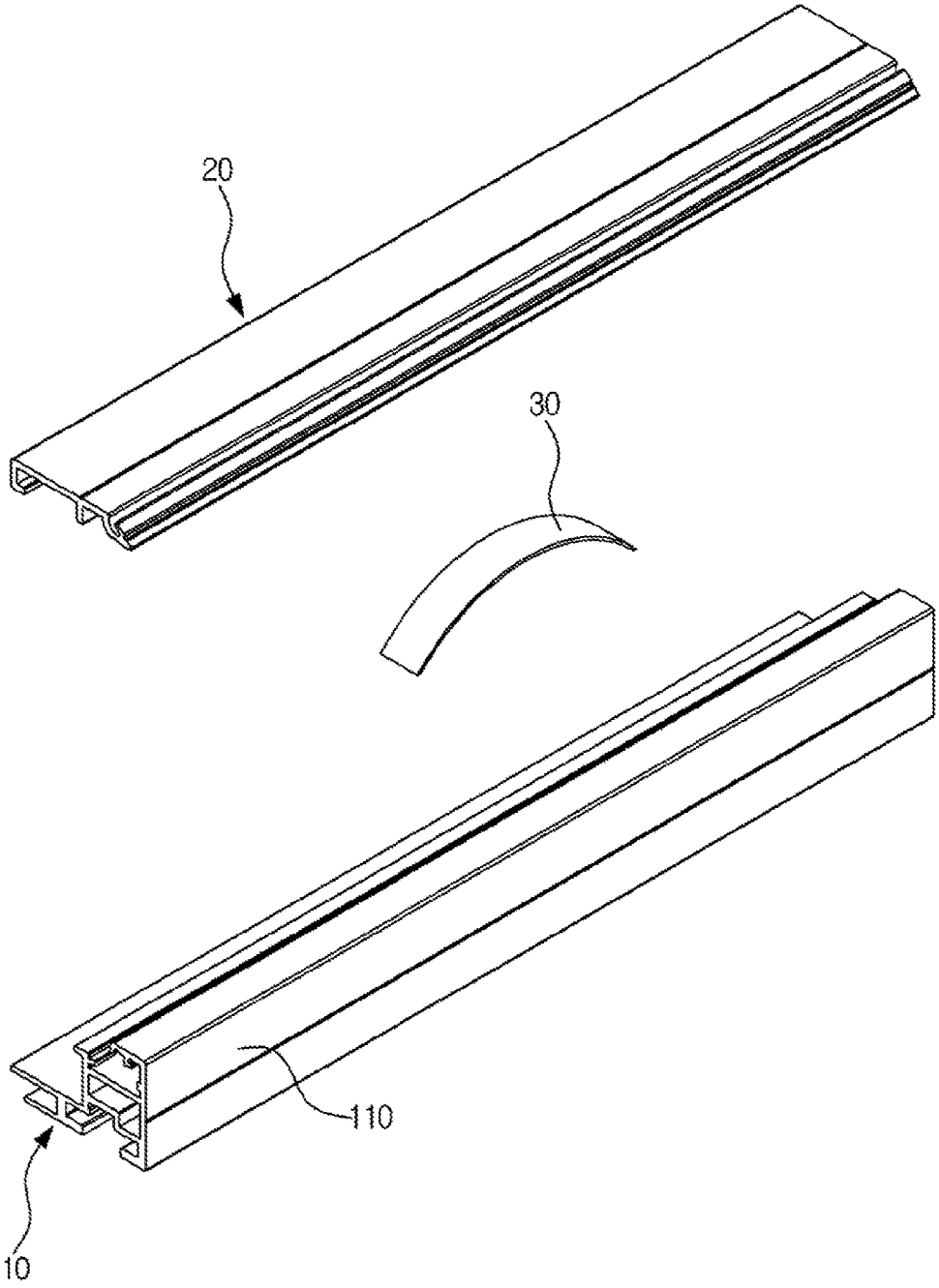
FIG. 2 is an exploded perspective view of FIG. 1.

FIG. 1 is a perspective view schematically illustrating a structure of a non-interference front-surface opening/closing-type frame according to one embodiment of the present invention, and FIG. 2 is an exploded perspective view of FIG. 1.

According to one embodiment, a structure of a non-interference front-surface opening/closing-type frame mainly includes: a fixing frame 10; a cover frame 20 rotatably coupled to the fixing frame 10; and an elastic member 30 interposed between the cover frame 20, as shown in FIGS. 1 and 2.

Figure 3:
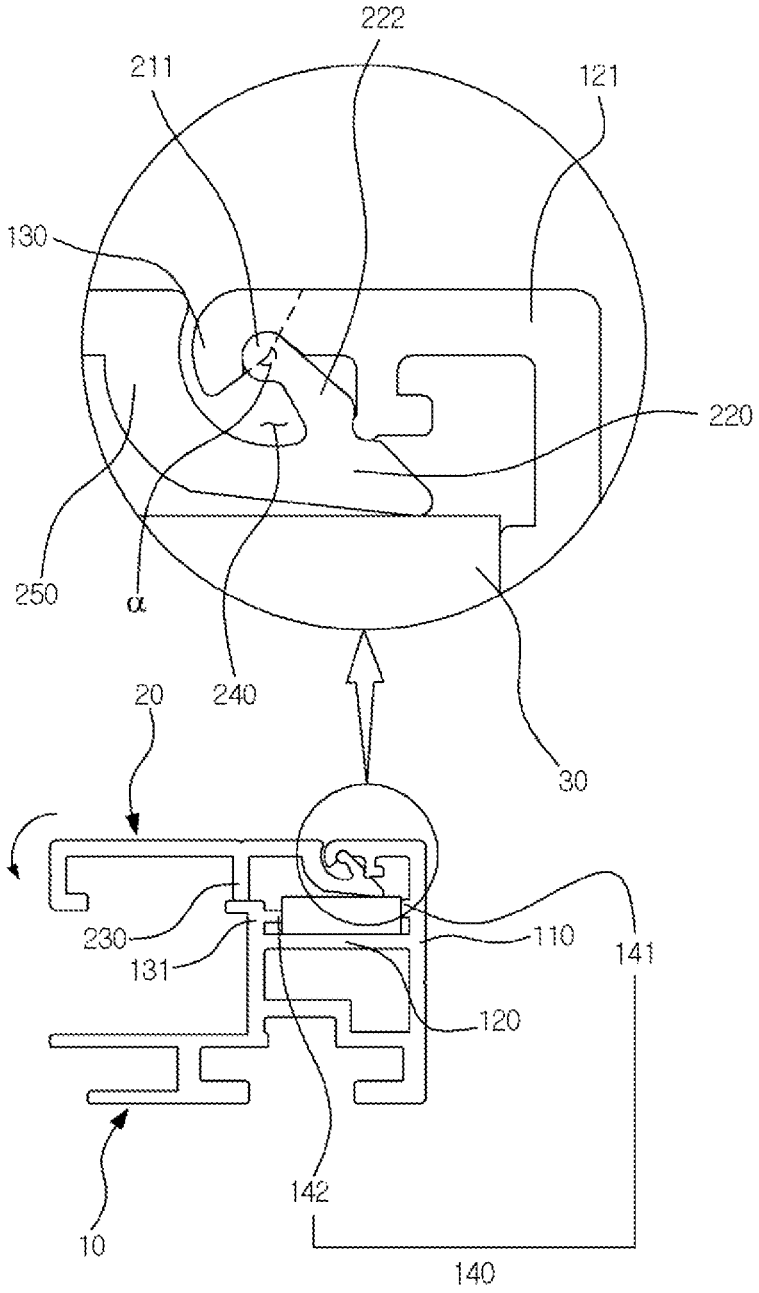
FIG. 3 is a front view schematically illustrating the state in which a cover frame of one embodiment closes a fixing frame of one embodiment.
Figure 4:
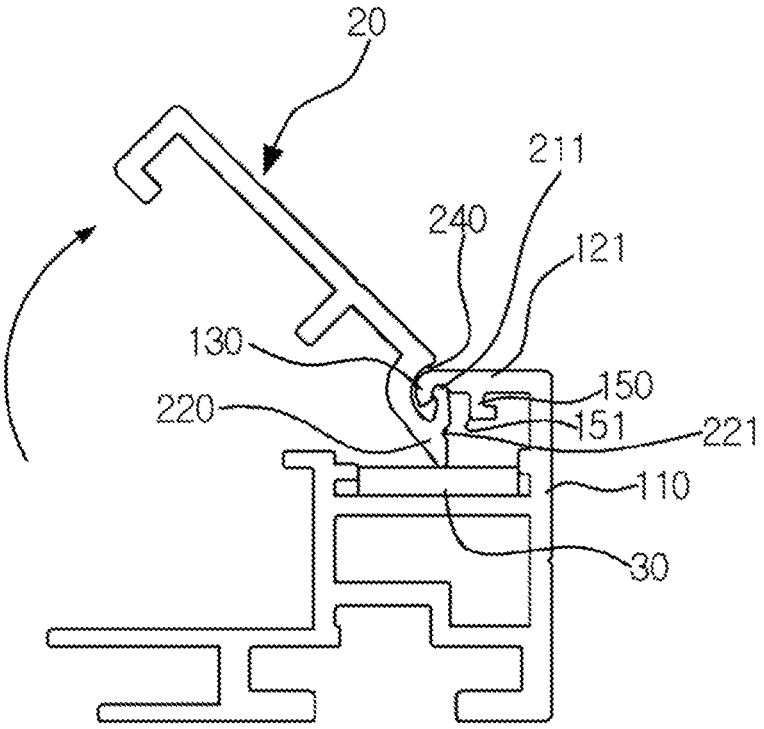
FIGS. 4 and 5 are front views schematically illustrating an operation in which a cover frame of one embodiment opens a fixing frame of one embodiment.
Figure 5:
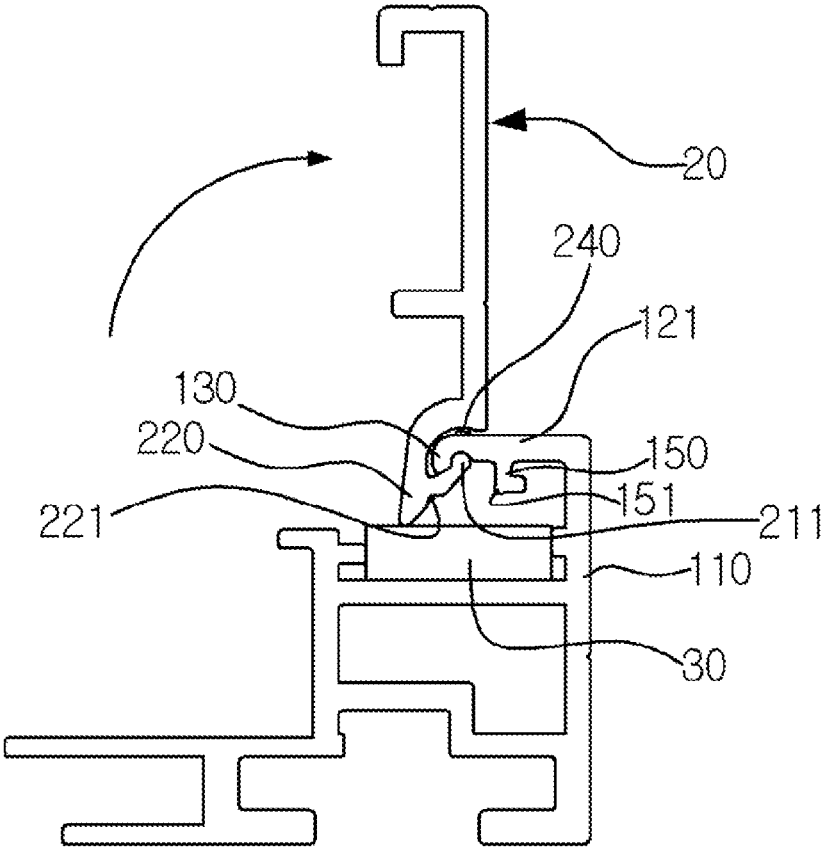

FIG. 3 is a front view schematically illustrating the state in which the cover frame of one embodiment closes the fixing frame of one embodiment, and FIGS. 4 and 5 are front views schematically illustrating an operation in which the cover frame of one embodiment opens the fixing frame of one embodiment.

First, a protrusion 130 is curved to protrude in one side, a lateral direction of the fixing frame 10, i.e., downward from one end of the upper portion of the fixing frame 10.

Figure 6:
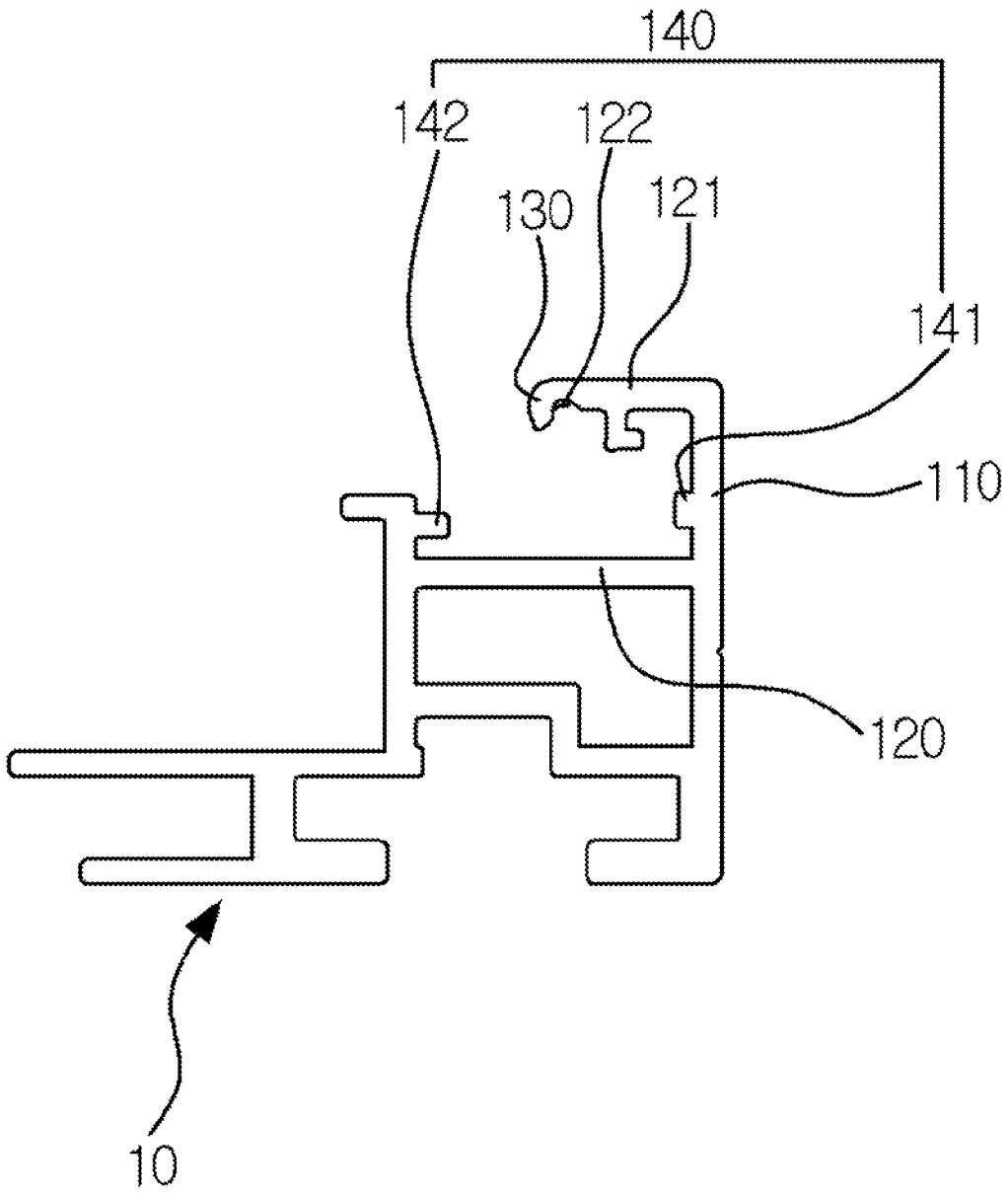
FIGS. 6 to 10 are front views sequentially illustrating an operation in which a cover frame of one embodiment is coupled to a fixing frame of one embodiment.

Also, a shaft groove 122 of FIG. 6 is opened inward and downward inside the protrusion 130.

More particularly, for one example, an upper plate part 121 extending horizontally by a predetermined length in one side, a lateral direction of the fixing frame 10 may be formed on the upper end of a vertical plate part 110 as shown in FIGS. 3 to 5, wherein the vertical plate part 110 extending vertically in an upward and downward direction of the fixing frame 10 is formed on the other side of the fixing frame 10.

The protrusion 130 may be formed on the bottom surface of one end of the upper plate part 121.

In addition, a seat plate 120 extending horizontally by a predetermined length in the one side, a lateral direction of the fixing frame 10 may be formed in the middle portion of one side surface of the vertical plate part 110, so as to be located under the upper plate part 121 of the fixing frame 10.

Above the one side of the seat plate 120, a protruding piece 131 protruding by a predetermined length in an upward direction of the seat plate 120 may be formed. Also, the upper portion of the protruding piece 131 may be bent horizontally by a predetermined length in one side, a lateral direction of the protruding piece 131.

Next, in the other side of the cover frame 20, the cover frame 20 includes: a rotating shaft 211 that has a spherical shape and the like, and may be inserted to the shaft groove 122; a compression piece 220 formed sharply inward and downward from the rotating shaft 211, wherein the compression piece 220 is elastically supported by the elastic member 30 and formed sharply inward and downward from the rotating shaft 211 in the state in which upper and lower portions thereof have an acute angle therebetween; and a connection piece 250 that connects the compression piece 220 to the other end of the cover frame 20.

Also, a connection part 222 connecting the rotating shaft 211 and the compression piece 220 may be formed between the rotating shaft 211 and the compression piece 220, while being inclined inward and downward from the rotating shaft 211.

It is preferable that the rotating shaft 211 has an outer diameter substantially smaller than that of the shaft groove 122 so that the rotating shaft 211 rotates smoothly, within the shaft groove 122, in forward and revere directions.

As shown in FIGS. 3 to 5, when the cover frame 20 opens the fixing frame 10 in such a manner in which one side of the cover frame 210 is rotated, with respect to the rotating shaft 211 formed on the other side of the cover frame 20, by an operator in an upward direction of the fixing frame 10, the cover-upper plate part 210 passes over in an outward direction of the other side of the fixing frame 10 while not being deviated.

The compression piece 220 aims to enhance an opening/closing force of the cover frame 20, and a relatively greater compressive elastic force may be generated on the elastic member 30 when the compression piece 220 is located between one side and the other side of the top portion of the elastic member 30, as shown in FIG. 4, than when it is located at one side of the top portion of the elastic member 30 and at the other side of the top portion of the elastic member 30.

That is, when the cover frame 20 closes the fixing frame 10 as shown in FIG. 3 or when the cover-upper plate part 210 of the cover frame 20 opens the fixing frame 10 as shown in FIG. 5, the compression piece 220 compresses the elastic member 30 with a relatively lower level to maintain its condition. On the other hand, when the compression piece 220 is located between one side of the top portion of the elastic member 30 and the other side of the top portion of the elastic member 30 as shown in FIG. 4, the compression piece 220 compresses the elastic member 30 with a relatively higher level such that a great compressive elastic force is generated. Therefore, the cover frame 20 rotates in an opening or closing direction by the tendency to move toward a region where the compressive elastic force is generated with a lower level.

Next, an opening angle (α) of the shaft groove 122 may be varied depending on a curved length of the protrusion 130. Particularly, the opening angle (α) of the shaft groove 122 of the fixing frame 10 may preferably range from 180° to 270°, and more preferably 205°, as shown in FIG. 3, in order to more conveniently couple the rotating shaft 211 right beneath the inside of the rotating shaft 211 and prevent the rotating shaft 211 coupled right beneath the inside of the shaft groove 122 from escaping while the cover-upper plate part 210 opens/closes the fixing frame 10.

When the opening angle (α) of the shaft groove 122 of the fixing frame 10 is less than 180°, it is difficult that the rotating shaft 211 is conveniently coupled right beneath the shaft groove 122 because the opening angle (α) of the shaft groove 122 is so small.

When the opening angle (α) of the shaft groove 122 of the fixing frame 10 is greater than 270°, there is a concern that the rotating shaft 211 coupled right beneath the shaft groove 122 is likely to escape outside while the cover frame 20 opens/closes the fixing frame 10 because the opening angle (α) of the shaft groove 122 is so large.

Next, all of the protrusion 130 of the fixing frame 10, the connection piece 250 of the cover frame 20, and the shaft groove 122 of the fixing frame 10 may be formed in a circular arc shape having the same center, i.e., the center of the rotating shaft 211 so that the cover frame 20 smoothly can open/close the fixing frame 10 without interference of the fixing frame 10.

Next, the elastic member 30 elastically supports the lower portion of the compression piece 220 of the cover frame 20 to maintain the open/closed state of the cover frame 20, in the state in which the elastic member 30 is seated on the top side of the seat plate 120 of the fixing frame 10 so as to be located between the cover frame 20 and the fixing frame 10.

The elastic member 30 may be formed as a leaf spring, but is not limited thereto. Thus any element can be used as long as it can maintain the open/closed state of the cover frame 20.

In order to prevent the elastic member 30 from wobbling due to the lateral movement from one side of the seat plate 120 to the other side of the seat plate 120, a fixing piece 140 may be further provided to stably fix a position of the elastic member 30.

The fixing piece 140 may include the other side-fixing piece 141 and one side-fixing piece 142.

The other side-fixing piece 141 protrudes from one side, a lateral surface of the vertical plate part 110 toward the other side of the elastic member 30 so as to be located between the upper plate part 121 and the seat plate 120, and thus may contact the other side of the elastic member 30.

The one side-fixing piece 142 protrudes from the other side surface of the protruding piece 131 formed above one side of the seat plate 120 toward one side of the elastic member 30, and thus may contact the one side of the elastic member 30.

Next, as shown in FIG. 3, when the fixing frame 10 is closed in the state in which one side of the cover-upper plate part 210 is rotated, with respect to the rotating shaft 211 of the cover frame 20, by an operator in a direction of one side of the fixing frame 10 and then descended, the cover frame 20 and the upper plate part 121 of the fixing frame 10 may be disposed on the same horizontal line or disposed to be offset from each other.

However, it is preferable that the cover frame 20 and the upper plate part 121 of the fixing frame 10 are made to be disposed on the same horizontal line, to thereby prevent the cover frame 20 from being vertically offset from the upper plate part 121 and also ensure that there is little gap between the cover frame 20 and the upper plate part 121 of the fixing frame 10, thereby further improving the aesthetic impression of the appearance of the non-interference front-surface opening/closing-type frame of the present invention.

Next, on the central lower portion of the cover frame 20, a supporting piece 230 may protrude by a predetermined length in a direction of the upper portion of the protruding piece 131 formed above the one side of the seat plate 120 of the fixing frame 10. The supporting piece 230 is seated on the upper portion of the protruding piece 131 formed above the one side of the seat plate 120 of the fixing frame 10.

When the cover frame 20 closes the fixing frame 10, the lower portion of the supporting piece 230 of the cover frame 20 is seated on the upper portion of the protruding piece 131 formed above the one side of the seat plate 120 of the fixing frame 10, thereby enabling a stable support of the cover frame 20 at a predetermined height to maintain the cover frame 20 horizontal.

Also, the supporting piece 230 may easily prevent the cover frame 20 from being pushed and pressed due to an external impact such as a pushing force applied to the cover frame 20, and thus can easily prevent the cover frame 20 from being separated from the fixing frame 10 due to the external impact such as the pushing force.

Meanwhile, although the cover frame 20 is pushed and pressed, the cover frame 20 is less likely to be easily separated from the fixing frame 10 unless an operator forcibly moves the cover frame 20 in an outward direction of the one side of the fixing frame 10.

Figure 10:
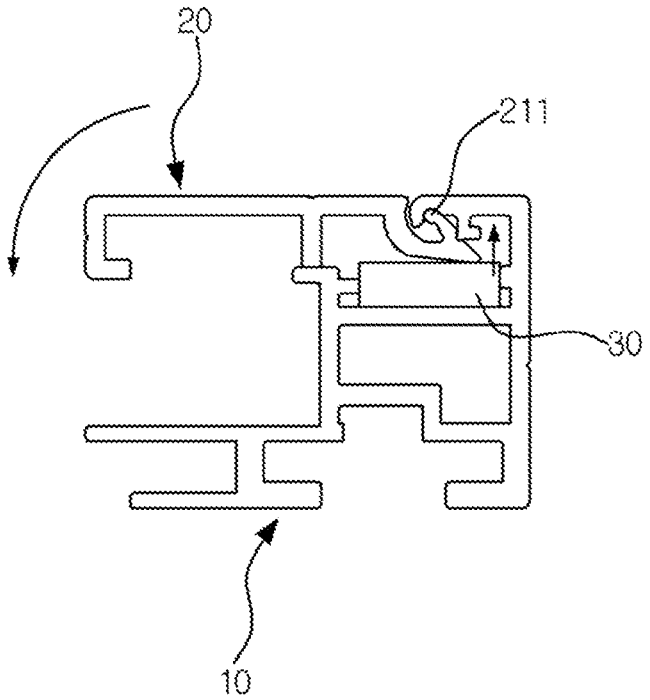

FIGS. 6 and 10 are front views sequentially illustrating an operation in which the cover frame of one embodiment is coupled to the fixing frame of one embodiment.

Next, the lower portion of the compression piece 220 may extend horizontally in '—' shape toward the vertical plate part 110.

Figure 8:
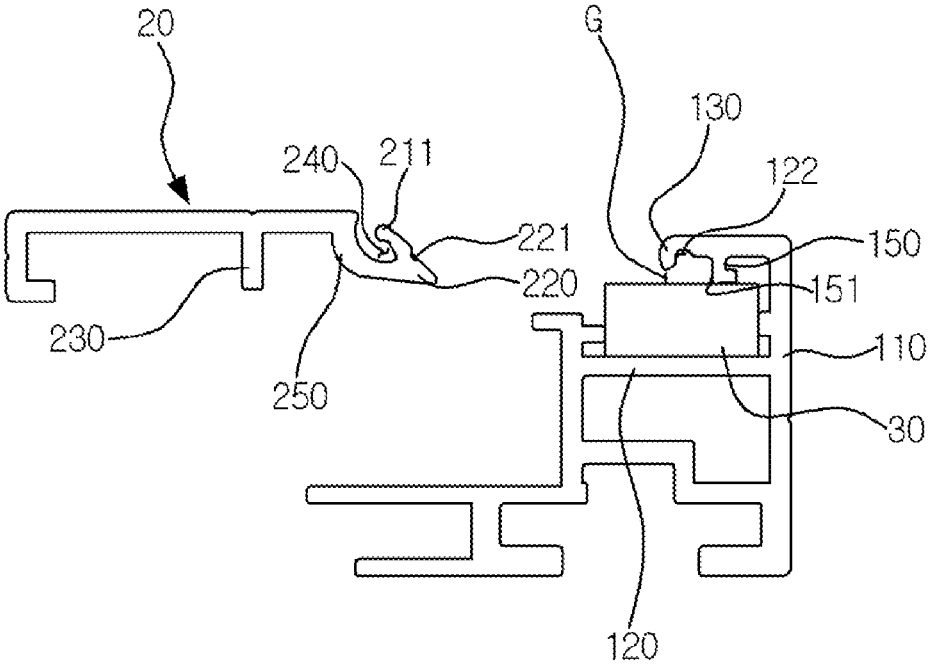

Alternatively, as shown in FIG. 8, the lower portion of the compression piece 220 may be inclined downward (N) to the vertical plate part 110.

As described above, since the lower portion of the compression piece 220 is formed to extend horizontally and incline downward, the vertical width between the lower portion of the rotating shaft 211 and the lower portion of the compression piece 220 may be substantially reduced to thereby realize slimness.

Next, as shown in FIG. 3, a guide groove 240 having a shape corresponding to the connection piece 250 may be formed between the top surface of the connection piece 250 and the lower side of the rotating shaft 211.

When the cover frame 20 opens the fixing frame 10 as shown in FIG. 5, the protrusion 130 of the fixing frame 10 is inserted into the guide groove 240 to be able to prevent the rotating shaft 211 from escaping from the shaft groove 122.

Figure 7:
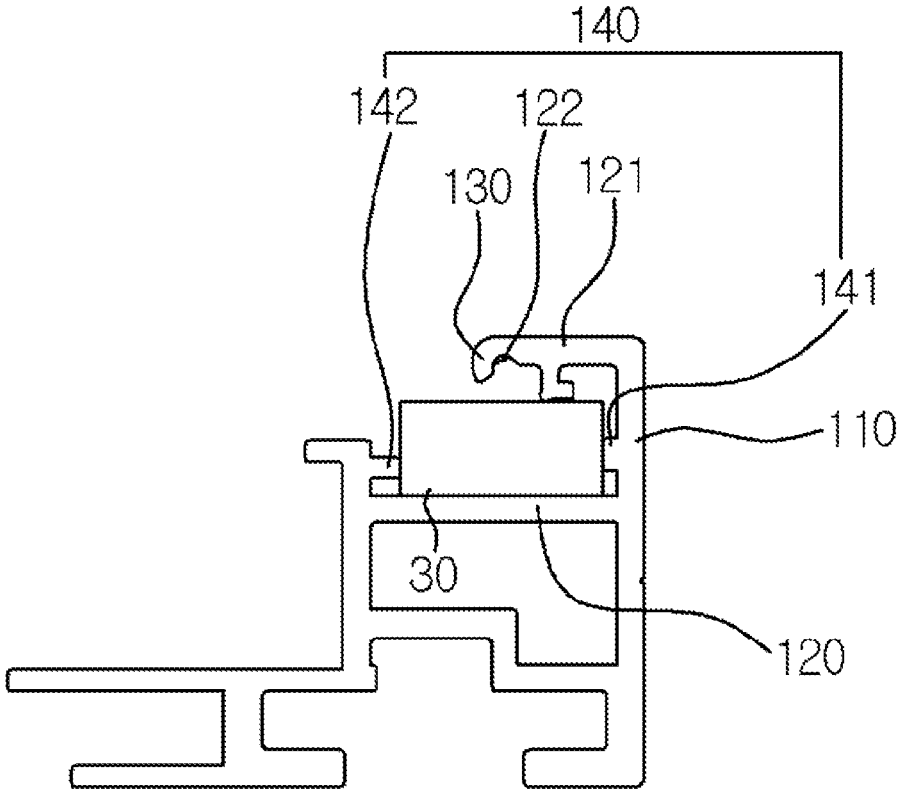
Figure 9:
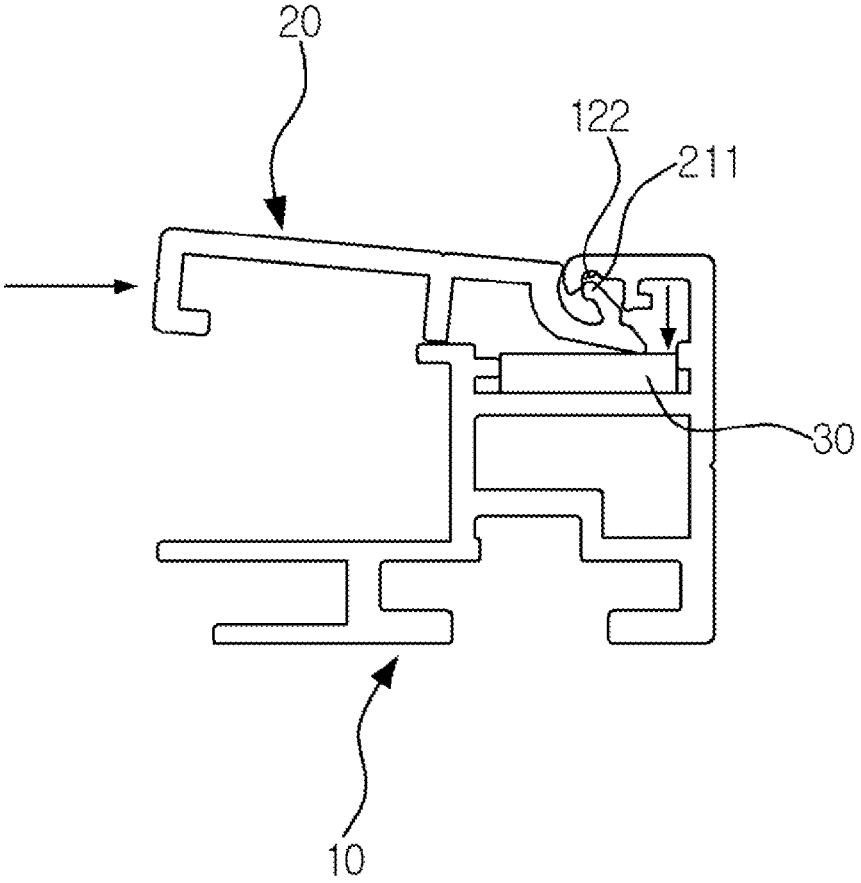

Next, in the state in which the elastic member 30 is seated on the top side of the seat plate 120 as shown in FIGS. 6 and 7, the assembling process may be simply performed in such a manner in which the cover frame 20 moves laterally from the one side of the fixing frame 10 to the other side of the fixing frame 10, and thus the rotating shaft 211 of the cover-upper plate part 210 is coupled right beneath the inside of the shaft groove 122 of the upper plate part 121 of the fixing frame 10, as shown in FIGS. 8 and 9. The above-described process will now be described in detail.

First, as shown in FIG. 8, a pressing piece 150, which protrudes by a predetermined length in a downward direction of the upper plate part 121 to press the upper portion of the elastic member 30, may be formed on a middle region of the bottom surface of the upper plate part 121 of the fixing frame 10, so as to be located in the inner upper portion of the fixing frame 10.

As shown in FIGS. 6 and 7, during a process in which the elastic member 30 is seated on the top side of the seat plate 120 of the fixing frame 10, the pressing piece 150 presses the upper portion of the elastic member 30 toward the seat plate 120, thereby creating a gap (G) between the upper portion of the elastic member 30 and the lower portion of the pressing piece 130 formed on one end portion of the upper plate part 121 of the fixing frame 10 as shown in FIG. 8.

As shown in FIGS. 9 and 10, in the state in which the compression piece 220 of the cover frame 20 passes through the gap (G) and the rotating shaft 211 is located under the shaft groove 122, the rotating shaft 211 ascends by an elastic force of the elastic member 30 and then may be conveniently coupled right beneath the inside of the shaft groove 122.

The pressing piece 150 allows the compression piece 220 of the cover frame 20 to pass through the gap (G) between the protrusion 130 of the fixing frame 10 and the elastic member 30 so as to assemble the fixing frame 10 and the cover frame 20, with no concern that the elastic member 30 may act as an interfering element.

Also, since the rotating shaft 211 of the cover frame 20 may be simply coupled right beneath the inside of the shaft groove 122 of the upper plate part 121 of the fixing frame 10 without interference of the elastic member 30, to thereby significantly improve assemblability between the cover frame 20 and the fixing frame 10. Also, in the specific case that the lower portion of the compression piece 220 is inclined downward (N), the compression piece 220 of the cover frame 20 may further press the elastic member 30 in a downward direction of the elastic member 30 while passing through the gap (G), to thereby further eliminate the concern that the compression piece 220 of the cover frame 20 is interfered with the elastic member 30 when passing through the gap (G).

Next, as shown in FIG. 8, an inserting groove 221, which is recessed by a predetermined depth in a direction of the lower portion of the compression piece 220, may be formed in the central region of the upper portion of the compression piece 220.

Also, an insertion projection 151, which protrudes toward the inserting groove 221 of the compression piece 220 and is inserted into the inserting groove 221, may be formed on one side of the lower portion of the pressing piece 150 formed on the central region of the lower portion of the upper plate part 121.

As the insertion projection 151 of the protruding piece 150 is inserted into the inserting groove 221 of the compression piece 220, the cover-upper plate part 210 of the cover frame 20 may easily maintain the closed state of the fixing frame 10.

Figure 11:
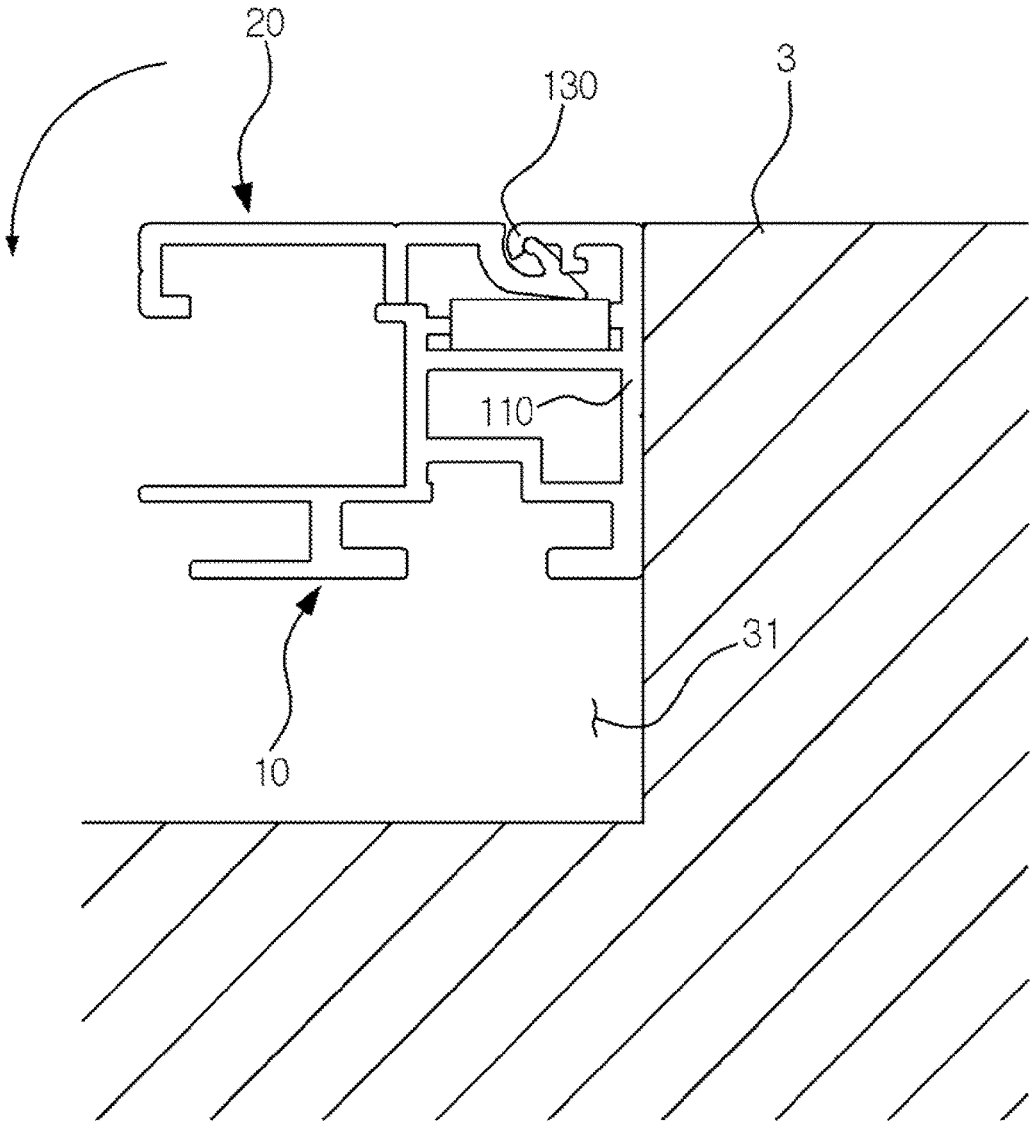
FIGS. 11 and 12 are front views schematically illustrating an operation in which a cover frame of one embodiment opens a fixing frame of one embodiment, which is installed to an inner groove of a structure such as a wall body, a window/door frame, and a furniture frame.
Figure 12:
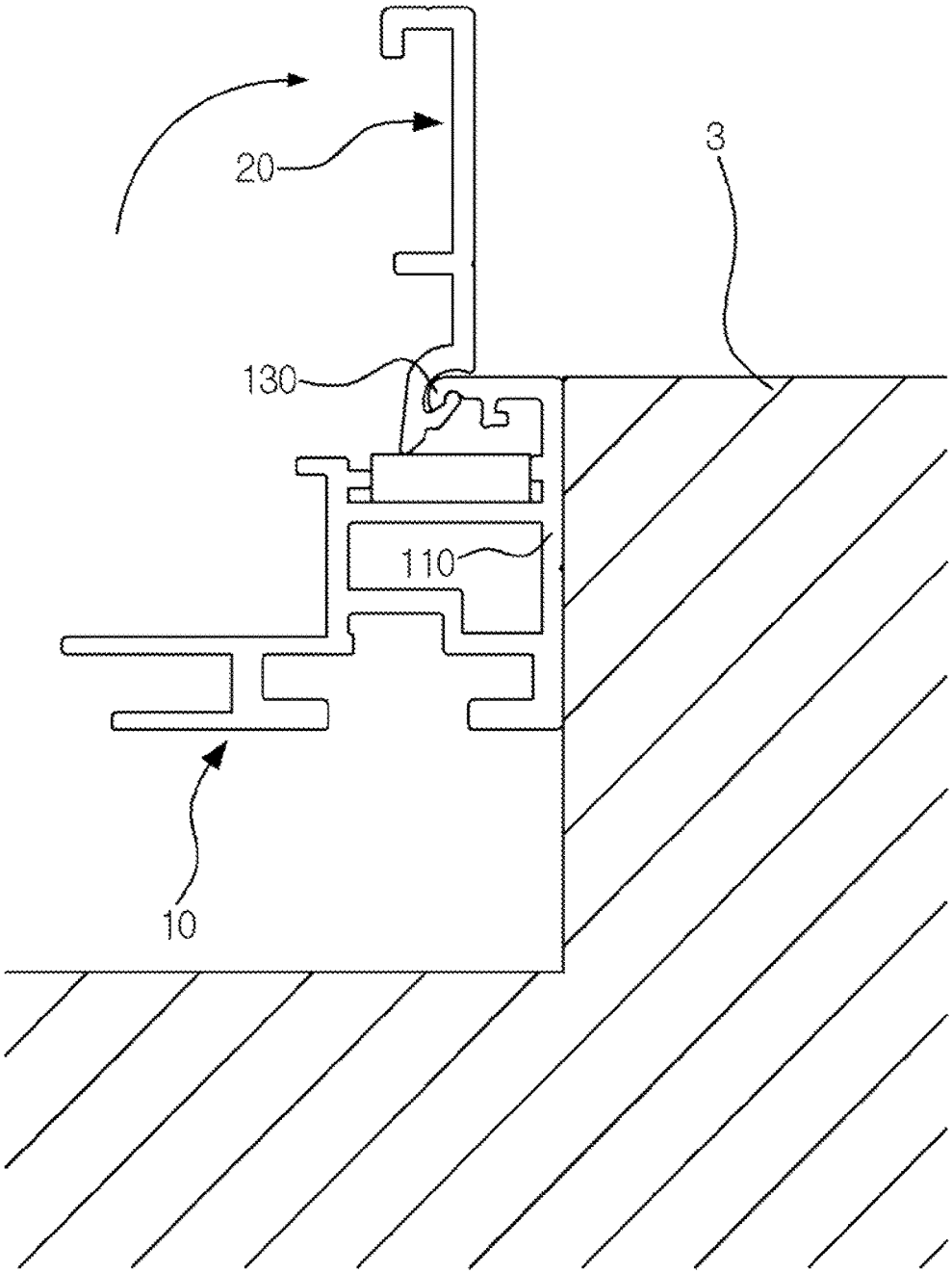

FIGS. 11 and 12 are front views schematically illustrating an operation in which the cover frame of one embodiment opens the fixing frame of one embodiment, which is installed to an inner groove of a structure such as a wall body, a window/door frame, and a furniture frame.

According to the present invention configured as described above, the rotating shaft 211 of the cover frame 20 is inserted into the shaft groove 122 of the protrusion 130 formed on the bottom surface of one end of the upper plate part 121, wherein the upper plate part 121 extends, from the upper end of the vertical plate part 110 formed on the other side of the fixing frame 10, horizontally by a predetermined length in one side, a lateral direction of the fixing frame 10. Thus, as shown in FIGS. 11 and 12, when the cover frame 20 opens the fixing frame 10 in such a manner in which the one side of the cover frame 20 is rotated in an upward direction of the fixing frame 10, the cover frame 20 passes over in an outward direction of the other side of the fixing frame 10 while not being deviated. Therefore, when the fixing frame 10 is fixed to an inner groove of a structure such as a building wall body, there is no concern that the cover frame 20 contacts the structure and is interfered with the structure. As a result, the cover frame 20 more simply opens the fixing frame 10, to thereby more easily and widely apply the structure of the non-interference front-surface opening/closing-type frame of the present invention to metal furniture of industrial materials, such as picture frames and door frames, or construction window/door frames.

Particularly, according to the present invention, since the rotating shaft 211 of the cover frame 20 may be conveniently coupled right beneath the shaft groove 122 of the fixing frame 10, the cover frame 20 may be so easily assembled with the fixing frame 10. Also, the protrusion 130, in which the shaft groove 122 is defined, protrudes downward from the one end of the fixing frame 10 in one side, a lateral direction, and the compression piece 220 included in the cover frame 20 and elastically supported by the elastic member 30 is formed to be sharp inward and downward from the rotating shaft 211, thereby easily preventing the cover frame 20 from being separated from the fixing frame 10 due to the external impact such as the pushing force applied to the cover frame 20.

INDUSTRIAL APPLICABILITY

According to the present invention, since a rotating shaft of a cover frame can be conveniently coupled right beneath a shaft groove of a fixing frame, the cover frame may be so easily assembled with the fixing frame. Also, a protrusion, in which the shaft groove is defined, protrudes downward from one end of the fixing frame in one side, a lateral direction, and a compression piece included in the cover frame and elastically supported by an elastic member is formed to be sharp inward and downward from the rotating shaft, thereby easily preventing the cover frame from being separated from the fixing frame due to an external impact such as a pushing force applied to the cover frame, and substantially reducing the vertical width between the lower portion of the rotating shaft of the cover frame and the lower portion of the compression piece to realize slimness.

In addition, since the protrusion of the fixing frame, a connection piece of the cover frame, and the shaft groove of the fixing frame are formed in a circular arc shape having the same center, the cover frame can smoothly open/close the fixing frame without interference of the fixing frame.

Also, since an opening angle of the shaft groove of the fixing frame ranges from 180° to 270°, the rotating shaft of the cover frame can be conveniently coupled right beneath the shaft groove of the fixing frame, and escapement of the rotating shaft coupled right beneath the inside of the shaft groove can be prevented while the cover frame opens/closes the fixing frame.

In addition, by means of a pressing piece formed in the inner upper portion of the fixing frame to press the elastic member, the compression piece of the cover frame is allowed to pass through the gap between the protrusion of the fixing frame and the elastic member in order to assemble the fixing frame and the cover frame, with no concern that the elastic member may act as an interfering element.

Also, by means of an insertion projection that is formed in the lower portion of the pressing piece of the fixing frame and inserted into an inserting groove formed in the upper portion of the compression piece of the cover frame, it may become easier to maintain the state in which the cover frame closes the fixing frame.

In addition, a supporting piece formed on the central lower portion of the cover frame is seated on the fixing frame to support the cover frame, and thus can easily prevent the cover frame from being pushed and pressed due to an external impact such as a pushing force, thereby easily preventing the cover frame from being separated from the fixing frame due to the external impact such as the pushing force.

Also, the rotating shaft of the cover frame is inserted into the shaft groove of the protrusion formed on the bottom surface of one end of an upper plate part, wherein the upper plate part extends, from the upper end of a vertical plate part formed on the other side of the fixing frame, horizontally by a predetermined length in one side, a lateral direction of the fixing frame. Thus, when the cover frame opens the fixing frame in such a manner in which one side of the cover frame is rotated in an upward direction of the fixing frame, the cover frame passes over in an outward direction of the other side of the fixing frame while not being deviated. Therefore, when the fixing frame is fixed to an inner groove of a structure such as a building wall body, there is no concern that the cover frame may be contacted to and interfered with the structure. As a result, the cover frame can more simply open the fixing frame, to thereby more easily and widely apply the structure of the non-interference front-surface opening/closing-type frame of the present invention to metal furniture of industrial materials, such as picture frames and door frames, or construction window/door frames.

The invention claimed is:

1. A structure of a non-interference front-surface frame, the structure comprising:

a fixing frame;

a cover frame rotatably coupled to the fixing frame; and an elastic member interposed between the fixing frame and the cover frame, wherein the fixing frame comprises:

a protrusion protruding downward from one end of the fixing frame in a lateral direction; and a shaft groove opened inward and downward inside the protrusion, and the cover frame comprises:

a rotating shaft inserted into the shaft groove;

a compression piece formed inward and downward from the rotating shaft and elastically supported by the elastic member; and a connection piece connecting another end of the cover frame and the compression piece, wherein a pressing piece, which protrudes in a downward direction of the fixing frame to press the elastic member, is formed in an inner upper portion of the fixing frame, and wherein, during a process in which the elastic member is seated on a top side of a seat plate of the fixing frame, the pressing piece presses an upper portion of the elastic member toward the seat plate, thereby creating a gap between the elastic member and the protrusion of the fixing frame.

2. The structure of claim 1, wherein the protrusion and the shaft groove of the fixing frame are formed in a circular arc shape having the same center.

3. The structure of claim 1, wherein the connection piece of the cover frame and the shaft groove of the fixing frame are formed in a circular arc shape having the same center.

4. The structure of claim 1, wherein an opening angle of the shaft groove of the fixing frame ranges from 180° to 270°.

5. The structure of claim 1, wherein the compression piece is formed inward and downward from the rotating shaft in a state in which upper and lower portions of the compression piece of the cover frame have an acute angle therebetween.

6. The structure of claim 1, wherein a connection part connecting the rotating shaft and the compression piece is formed between the rotating shaft and the compression piece of the cover frame while being inclined inward and downward from the rotating shaft.

7. The structure of claim 1, wherein an insertion projection is formed in a lower portion of the pressing piece, and an inserting groove, into which the insertion projection is inserted, is formed in an upper portion of the compression piece.

8. The structure of claim 1, wherein a supporting piece, which is seated on the fixing frame to support the cover frame, is formed on a central lower portion of the cover frame.

9. The structure of claim 1, wherein an upper plate part, which horizontally extends by a predetermined length in one side or a lateral direction of the fixing frame, is formed on an upper end of a vertical plate part formed on another side of the fixing frame, and the protrusion is formed on a bottom surface of one end of the upper plate part.

10. The structure of claim 4, wherein the opening angle of the shaft groove of the fixing frame is 205°.

11. A structure of a non-interference front-surface frame, the structure comprising:

a fixing frame;

a cover frame rotatably coupled to the fixing frame; and an elastic member interposed between the fixing frame and the cover frame, wherein the fixing frame comprises:

a protrusion protruding downward from one end of the fixing frame in a lateral direction; and a shaft groove opened inward and downward inside the protrusion, and the cover frame comprises:

a rotating shaft inserted into the shaft groove;

a compression piece formed inward and downward from the rotating shaft and elastically supported by the elastic member; and a connection piece connecting another end of the cover frame and the compression piece, wherein a pressing piece, which protrudes in a downward direction of the fixing frame to press the elastic member, is formed in an inner upper portion of the fixing frame, and wherein, during a process in which the elastic member is seated on a top side of a seat plate of the fixing frame, the pressing piece presses an upper portion of the elastic member toward the seat plate, thereby creating a gap between the elastic member and the protrusion of the fixing frame, wherein, an opening angle of the shaft groove of the fixing frame ranges from 180° to 270° so as to couple the rotating shaft beneath an inside of the shaft groove and prevent the rotating shaft coupled beneath the inside of the shaft groove from escaping while a cover-upper plate part opens or closes the fixing frame, and in the state in which the compression piece of the cover frame passes through the gap and the rotating shaft is located under the shaft groove, the rotating shaft ascends by an elastic force of the elastic member and then be conveniently coupled beneath the inside of the shaft groove.

12. The structure of claim 11, wherein an insertion projection is formed in a lower portion of the pressing piece, and an inserting groove, into which the insertion projection is inserted, is formed in an upper portion of the compression piece.

13. A structure of a non-interference front-surface frame, the structure comprising:

a fixing frame;

a cover frame rotatably coupled to the fixing frame; and an elastic member interposed between the fixing frame and the cover frame, wherein the fixing frame comprises:

a protrusion protruding downward from one end of the fixing frame in a lateral direction; and a shaft groove opened inward and downward inside the protrusion, and the cover frame comprises:

a rotating shaft inserted into the shaft groove;

a compression piece formed inward and downward from the rotating shaft and elastically supported by the elastic member; and a connection piece connecting another end of the cover frame and the compression piece, wherein a pressing piece, which protrudes in a downward direction of the fixing frame to press the elastic member, is formed in an inner upper portion of the fixing frame, and wherein a pressing operation of the elastic member by the pressing piece creates a gap between the elastic member and the protrusion of the fixing frame.

* * * * *